US005283224A

United States Patent [19]

Neumann

[11] Patent Number: 5,283,224

[45] Date of Patent: Feb. 1, 1994

[54] OVERCOAT LAYER FOR DYE-DONOR ELEMENT FOR LASER-INDUCED THERMAL DYE TRANSFER SYSTEM

[75] Inventor: Stephen M. Neumann, Rochester, N.Y.

[73] Assignee: Eastman Kodak Company, Rochester, N.Y.

[21] Appl. No.: 980,883

[22] Filed: Nov. 24, 1992

[51] Int. Cl.[5] ..... B41M 5/035; B41M 5/38

[52] U.S. Cl. ..... 503/227; 428/195; 428/206; 428/323; 428/327; 428/478.2; 428/913; 428/914; 430/201; 430/945

[58] Field of Search ..... 8/471; 428/195, 323, 428/327, 207, 913, 914, 206, 478.2; 430/201, 945; 503/227

[56] References Cited

U.S. PATENT DOCUMENTS 4,772,582 9/1988 DeBoer ..... 503/227
5,214,023 5/1993 Aono ..... 503/227

FOREIGN PATENT DOCUMENTS 61-262190 11/1986 Japan ..... 503/227

*Primary Examiner*—Bruce H. Hess
*Attorney, Agent, or Firm*—Harold E. Cole

[57] ABSTRACT

This invention relates to a dye-donor element for thermal dye transfer comprising a support having thereon a dye layer comprising an image dye dispersed in a binder, the dye layer having an infrared-absorbing material associated therewith, and wherein the binder has been coated from an aqueous dispersion and consists essentially of a hydrophilic polymer which has been set, the dye layer having an overcoat layer comprising spacer beads dispersed in a polymeric binder.

18 Claims, No Drawings

OVERCOAT LAYER FOR DYE-DONOR ELEMENT FOR LASER-INDUCED THERMAL DYE TRANSFER SYSTEM

This invention relates to the use of a particular overcoat layer for a dye-donor element of a laser-induced thermal dye transfer system.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

In copending U.S. Ser. No. 07/980,895, filed Nov. 24, 192, entitled "Dye-Donor Binder For Thermal Dye Transfer Systems", of Neumann and Guittard, dye-binders are disclosed which are coated from an aqueous dispersion and consist essentially of a hydrophilic polymer which has been set. There is no disclosure in that application, however, of the use of spacer beads in an overcoat layer of the element.

In U.S. Pat. No. 4,772,582, there is a disclosure of an overcoat layer containing spacer beads for a laser-induced dye-donor element for thermal dye transfer, the dye layer being cast from an organic solvent. The beads enhance image uniformity, reduce occurrence of mottle and assure more efficient use of thermal energy. There is a problem with these beads, however, in that they are susceptible to the influence of stress forces which tend to readily dislodge the beads from the surface of the element and thereby render it less effective than desired.

It is an object of this invention to improve the adhesion of spacer beads in a dye-donor element designed for laser processing.

These and other objects are achieved in accordance with this invention which comprises a dye-donor element for thermal dye transfer comprising a support having thereon a dye layer comprising an image dye dispersed in a binder, the dye layer having an infrared-absorbing material associated therewith, and wherein the binder has been coated from an aqueous dispersion and consists essentially of a hydrophilic polymer which has been set, the dye layer having an overcoat layer comprising spacer beads dispersed in a polymeric binder.

A hydrophilic polymer which has been set is one which is "settable" when coated, i.e., its viscosity vs. temperature curve shows a discontinuity due to formation of a three-dimensional network at this setting point of the binder.

Settable hydrophilic polymers which are useful in the invention include, for example, gelatin; thermoreversible materials that gel on cooling, e.g., corn and wheat starch, agar and agarose materials, xanthan gums, and certain polymers derived from acrylamides and methacrylamides as disclosed in U.S. Pat. Nos. 3,396,030 and 2,486,192; thermoreversible materials that gel on heating, e.g., certain polyoxyethylene-polyoxpropylenes as disclosed by I. R. Schmolka in J. Am. Oil Chem. Soc., 1977, 54, 110 and J. Rassing, et al., in J. of Molecular Liquids, 1984, 27, 165; some polysaccharides; and polymers with a hydrophilic group from a water-soluble ionic vinyl monomer and a hydrophobic group from an acrylamide or methacrylamide as, disclosed in U.S. Ser. No. 742,784, now abandoned, of Roberts et al., filed Aug. 8, 1991.

The hydrophilic polymer which has been set which is used in the invention can be employed at a coverage of from about 0.2 to about 5 g/m$^2$.

By use of the invention, the tendency of beads to become dislodged in a dye-donor element designed for laser processing is reduced. In addition, substantial improvements in dye transfer uniformity can be obtained. Also, since the coating systems are aqueous, environmental hazards are reduced because no organic solvents are used.

The spacer beads employed in the overcoat layer may be employed in any concentration or particle size effective for the intended purpose. In general, the beads used have such a particle size and are employed in such an amount so that effective contact between the dye-donor and dye-receiving element is prevented during the laser-induced thermal dye transfer.

It is believed that by having the spacer beads in a separate layer over the dye layer, an air gap is created between the dye-donor and receiver which helps insulate the receiving layer from the dye-donor, thereby improving dye transfer.

Any spacer beads may be employed in the invention provided they have the particle size and concentration as described above. In general, the spacer beads should have a particle size ranging from about 3 to about 100 μm, preferably from about 5 to about 50 μm. The coverage of the spacer beads may range from about 50 to about 100,000 beads/cm$^2$. In a preferred embodiment of the invention, the spacer beads are present at a concentration of from about 60 to about 60,000 cm$^2$. The spacer beads do not have to be spherical and may be of any shape.

The spacer beads may be formed of polymers such as polystyrene, phenol resins, melamine resins, epoxy resins, silicone resins, polyethylene, polypropylene, polyesters, polyimides, etc.; metal oxides; minerals; inorganic salts; organic pigments; etc. In general, the spacer beads should be inert and insensitive to heat at the temperature of use.

The spacer beads are coated with a polymeric binder to aid in physical handling. In general, good results have been obtained with binders such as higher polysaccharides e.g., starch, dextran, dextrin, corn syrup, etc.; cellulose derivatives; acrylic acid polymers; polyesters; poly(vinyl acetate); etc. In a preferred embodiment of the invention, poly(vinyl acetate) is employed. The binder should be dye-permeable, insoluble to the spacer beads and dye and should be coated with a minimum amount so that the spacer beads project above the overcoat layer. In general, good results have been obtained at a concentration of about 0.002 to about 0.2 g/m$^2$.

In another preferred embodiment of the invention, the infrared-absorbing dye is in the dye layer.

To obtain the laser-induced thermal dye transfer image employed in the invention, a diode laser is preferably employed since it offers substantial advantages in terms of its small size, low cost, stability, reliability, ruggedness, and ease of modulation. In practice, before any laser can be used to heat a dye-donor element, the element must contain an infrared-absorbing material, such as cyanine infrared-absorbing dyes as described in U.S. Pat. No. 4,973,572, or other materials as described in the following U.S. Pat. Nos. 4,948,777, 4,950,640, 4,950,639, 4,948,776, 4,948,778, 4,942,141, 4,952,552, 5,036,040, and 4,912,083, the disclosures of which are hereby incorporated by reference. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat. The infrared-absorbing dye may be contained in the dye layer itself or in a separate layer associated therewith.

Lasers which can be used to transfer dye from dye-donors employed in the invention are available commercially. There can be employed, for example, Laser Model SDL-2420-H2 from Spectra Diode Labs, or Laser Model SLD 304 V/W from Sony Corp.

A thermal printer which uses a laser as described above to form an image on a thermal print medium is described and claimed in copending U.S. application Ser. No. 451,656 of Baek and DeBoer, filed Dec. 18, 1989, now U.S. Pat. No. 5,168,288, the disclosure of which is hereby incorporated by reference.

Any dye can be used in the dye-donor employed in the invention provided it is transferable to the dye-receiving layer by the action of the laser. Especially good results have been obtained with sublimable dyes such as anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

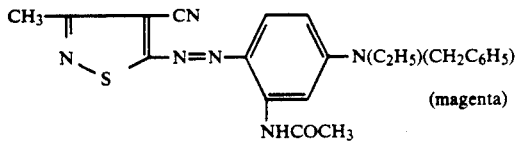
(magenta)

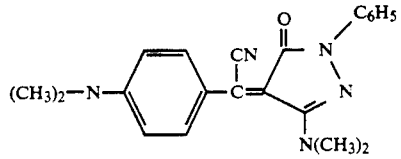
(magenta)

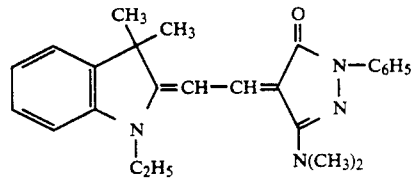
(yellow)

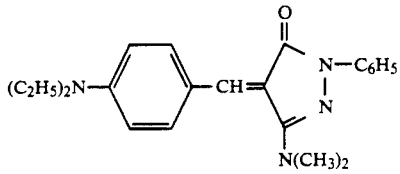
(yellow)

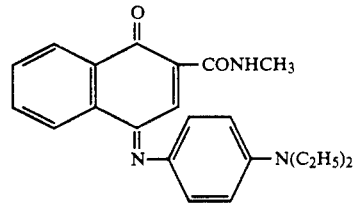
(cyan)

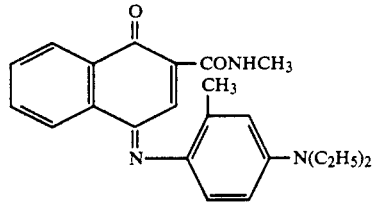
(cyan)

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 g/m$^2$ and are preferably hydrophobic.

The dye layer of the dye-donor element may be coated on the support or printed thereon by a printing technique such as a gravure process.

Any material can be used as the support for the dye-donor element employed in the invention provided it is dimensionally stable and can withstand the heat of the laser. Such materials include polyesters such as poly(ethylene terephthalate); polyamides; polycarbonates; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 μm. It may also be coated with a subbing layer, if desired, such as those materials described in U.S. Pat. Nos. 4,695,288 or 4,737,486.

The dye-receiving element that is used with the dye-donor element employed in the invention comprises a support having thereon a dye image-receiving layer. The support may be glass or a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as DuPont Tyvek®. In a preferred embodiment, a transparent film support is employed.

The dye image-receiving layer may comprise, for example, a polycarbonate, a polyurethane, a polyester, poly(vinyl chloride(, poly(styrene-co-acrylonitrile), polycaprolactone or mixtures thereof. The dye image-receiving layer may be present in any amount which is effective for the intended purpose. In general, good results have been obtained at a concentration of from about 1 to about 5 g/m$^2$.

A process of forming a laser-induced thermal dye transfer image according to the invention comprises:

a) contacting at least one dye-donor element comprising a support having thereon a dye layer comprising a dye in a binder as described above having an infrared-absorbing material associated therewith, with a dye-receiving element comprising a support having thereon a polymeric dye image-receiving layer;

b) imagewise-heating the dye-donor element by means of a laser; and c) transferring a dye image to the dye-receiving element to form the laser-induced thermal dye transfer image.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed three times using different dye-donor elements. After the first dye is transferred, the elements are peeled apart. A second dye-donor element (or another area of the donor element with a different dye area) is then brought in register with the dye-receiving element and the process repeated. The third color is obtained in the same manner.

The following example is provided to illustrate the invention.

EXAMPLE

The first magenta dye illustrated above was dispersed in an aqueous medium containing the following surfactant: A2 Triton® X-200 (Union Carbide Corp.). The exact formulation is shown in Table 1

TABLE 1

| COMPONENT | QUANTITY (grams) |
|---|---|
| Magenta Dye | 250 |
| 18.2% aq. Triton® X-200 A2 Dispersing Agent | 275 |
| Distilled Water | 476 |

The formulation, as shown in Table I, was milled at 16° C. in a 1-liter media mill (Model LME1, Netzsch Inc.) filled to 75% by volume with 0.4 to 0.6 mm zirconia silica medium (obtainable from Quartz Products Corp., SEPR Division, Plainfield N.J.). The slurry was milled until a mean near infrared turbidity measurement indicated the particle size to have been less than or equal to 0.2 μm by discrete wavelength turbidimetry. This corresponded to a milling residence time of 45–90 minutes. Yellow and cyan dye-donor elements were prepared in the same way using the second yellow and second cyan dye illustrated above.

An aqueous carbon black (infrared-absorbing species) dispersion was prepared in a similar manner according to the formulation shown in Table II.

TABLE II

| Carbon Black Dispersion | |
|---|---|
| COMPONENT | QUANTITY (grams) |
| Carbon Black (Black Pearls 430 from Cabot Chemical Co.) | 200 |
| 18.2% aq. Triton® X-200 A2 Dispersing Agent | 165 |
| Distilled Water | 635 |

Magenta Donor:

A gel-subbed 100 μm poly(ethylene terephthalate) support was coated with 5.4 g/m$^2$ of deionized bovine gelatin (Type IV) and 0.54 g/m$^2$ of bis(vinylsulfonyl)methane, and then overcoated with 0.57 g/m$^2$ of the magenta dye dispersion, 0.22 g/m$^2$ of the carbon black dispersion, and 0.108 g/m$^2$ of deionized bovine gelatin (Type IV), coated from water at 4.325% solids. This layer was then overcoated with 10 μm divinylbenzene beads (0.047 g/m$^2$) in poly(vinyl acetate), Vinac XX-210® (Air Products Corp.).

Yellow Donor:

A gel-subbed 100 μm poly(ethylene terephthalate) support was coated with 5.4 g/m$^2$ of deionized bovine gelatin (Type IV) and 0.54 g/m$^2$ of bis(vinylsulfonyl)methane, and then overcoated with 0.55 g/m$^2$ of the yellow dye dispersion, 0.22 g/m$^2$ of the carbon black dispersion, and 0.22 g/m$^2$ of deionized bovine gelatin (Type IV), coated from water at 4.325% solids. This layer was then overcoated with 10 μm divinylbenzene beads (0.047 g/m$^2$) in poly(vinyl acetate), Vinac XX-210® (Air Products Corp.).

Cyan Donor:

A gel-subbed 100 μm poly(ethylene terephthalate) support was coated with 5.4 g/m² of deionized bovine gelatin (Type IV) and 0.54 g/m² of bis(vinylsulfonyl)methane, and then overcoated with 0.79 g/m² of the cyan dye dispersion, 0.22 g/m² of the carbon black dispersion, and 0.108 g/m² of deionized bovine gelatin (Type IV), coated from water at 4.325% solids. This layer was then overcoated with 10 μm divinyl (0.047 g/m²) in poly(vinyl acetate), Vinac XX-210® (Air Products Corp.).

Control Magenta Donor:

A 100 μm poly(ethylene terephthalate) support was coated with 0.29 g/m² each of the magenta dyes illustrated above, 0.40 g/m² of the infrared-absorbing dye illustrated below, and 0.294 g/m² of cellulose acetate propionate (2.5% acetyl, 46% propionyl). This layer was then overcoated with 10 μm divinylbenzene beads (0.047 g/m²) in poly(vinyl acetate), Vinac XX-210® (Air Products Corp.).

Control Yellow Donor:

A 100 μm poly(ethylene terephthalate) support was coated with 0.26 g/m² each of the yellow dyes illustrated above, 0.12 g/m² of the infrared-absorbing dye illustrated below, and 0.26 g/m² of cellulose acetate propionate (2.5% acetyl, 46% propionyl). This layer was then overcoated with 10 μm divinylbenzene beads (0.047 g/m²) in poly(vinyl acetate), Vinac XX-210® (Air Products Corp.).

Control Cyan Donor:

A 100 μm poly(ethylene terephthalate) support was coated with 0.58 g/m² each of the cyan dyes illustrated above, 0.027 g/m² of the infrared-absorbing dye illustrated below, and 0.18 g/m² of cellulose acetate propionate (2.5% acetyl, 46% propionyl). This layer was then overcoated with 10 μm divinylbenzene beads (0.047 g/m²) in poly(vinyl acetate), Vinac XX-210® (Air Products Corp.).

IR Absorbing Cyanine Dye

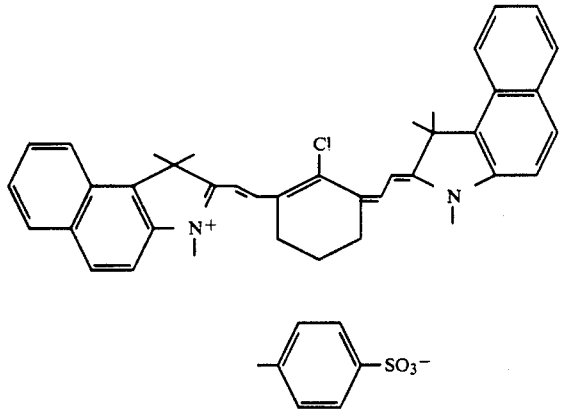

A dye-receiving element was prepared from flat samples (1.5 mm thick) of Ektar® DA003 (Eastman Kodak), a mixture of bisphenol A polycarbonate and poly(1,4-cyclohexylene dimethylene terephthalate) (50:50 mole ratio).

The above donor elements were wiped with a piece of tissue paper and imaged with a transverse mode, 50 mW laser running at full throughput power using a laser imaging device similar to the one described in U.S. Ser. No. 457,595 of Sarraf et al, filed Dec. 27, 1989, now U.S. Pat. No. 5,105,206, entitled "Thermal Slide Laser Printer". The laser imaging device consisted of a single diode laser (Hitachi Model HL8351E) fitted with collimating and beam shaping optical lenses. The laser beam was directed onto a galvanometer mirror. The rotation of the galvanometer mirror controlled the sweep of the laser beam along the x-axis of the image. The reflected beam of the laser was directed onto a lens which focused the beam onto a flat platen equipped with vacuum grooves. The platen was attached to a moveable stage the position of which was controlled by a lead screw which determined the y-axis position of the image. The dye-receiver was held tightly to the platen by means of the vacuum grooves, and each dye-donor element was held tightly to the dye-receiver by a second vacuum groove.

The laser beam had a wavelength of 830 nm and a power output of 37 mWatts at the platen. The measured spot size of the laser beam was nominally an oval of 7 by 9 μm (with the long dimension in the direction of the laser beam sweep). The center-to-center line distance was 8.9 μm and the laser scanning speed was 26.9 Hz.

After each imaging process, the removal of the donor element by a suction removal device (a mechanical arm with a suction cup and vacuum to lift the donor from the receiver) was observed to determine if sticking to the receiver occurred and if so to what degree. Thus, sticking is defined as a state where the vacuum removal devices could not separate donor and receiver.

This process was repeated ten times for each donor element described above. No sticking occurred with any of the above donor elements if the elements were not wiped with tissue paper. The presence of sticking is taken to mean that spacer beads were removed by the wiping step, while no sticking indicates a robust adhesion of beads to the donor element. Table III lists the results of these experiments.

TABLE III

| NUMBER OF TIMES DONOR STICKING OBSERVED | | | |
|---|---|---|---|
| Donor | Yellow | Magenta | Cyan |
| Invention | 0 | 4* | 0 |
| Control | 10 | 10 | 10 |

*In two samples, adhesion occurred between donor and receiver, but the vacuum removal devices could easily effect a separation. In two other samples, there was barely discernible sticking.

The data clearly show a significant improvement in adhesion between spacer bead overcoat and dye-donor layer when the donor binder is gelatin, instead of a polymer cast from an organic solvent.

The invention has been described in detail with particular reference to preferred embodiments thereof, but it will be understood that variations and modifications can be effected within the spirit and scope of the invention.

What is claimed is:

1. In a dye-donor element for laser-induced thermal dye transfer comprising a support having thereon a dye layer comprising an image dye dispersed in a polymeric material, said dye layer having an infrared-absorbing material associated therewith, the improvement wherein the polymeric material has been coated from an aqueous dispersion and consists essentially of a hydrophilic polymer which has been set, said dye layer also having an overcoat layer comprising spacer beads dispersed in a polymeric binder.

2. The element of claim 1 wherein said hydrophilic polymer is gelatin.

3. The element of claim 1 wherein said infrared-absorbing material is in said dye layer.

4. The element of claim 1 wherein said beads which are employed have such a particle size and are employed in such an amount so that effective contact between said dye-donor and a dye-receiving element is prevented during the laser-induced thermal dye transfer.

5. The element of claim 4 wherein said spacer beads have a particle size from about 5 to about 50 μm and are present at a concentration of from about 60 to about 60,000/cm$^2$.

6. The element of claim 1 wherein said beads are dispersed in poly(vinyl acetate).

7. In a process of forming a laser-induced thermal dye transfer image comprising:

a) contacting at least one dye-donor element comprising a support having thereon a dye layer comprising an image dye dispersed in a polymeric material, said dye layer having an infrared-absorbing material associated therewith, with a dye-receiving element comprising a support having thereon a polymeric dye image-receiving layer;

b) imagewise-heating said dye-donor element by means of a laser; and c) transferring a dye image to said dye-receiving element to form said laser-induced thermal dye transfer image, the improvements wherein the polymeric material has been coated from an aqueous dispersion and consists essentially of a hydrophilic polymer which has been set, said dye layer also having an overcoat layer comprising spacer beads dispersed in a polymeric binder.

8. The process of claim 7 wherein said hydrophilic polymer is gelatin.

9. The process of claim 7 wherein said infrared-absorbing material is in said dye layer.

10. The process of claim 7 wherein said beads which are employed have such a particle size and are employed in such an amount so that effective contact between said dye-donor and said dye-receiving element is prevented during the laser-induced thermal dye transfer.

11. The process of claim 10 wherein said spacer beads have a particle size from about 5 to about 50 μm and are present at a concentration of from about 60 to about 60,000/cm$^2$.

12. The process of claim 7 wherein said beads are dispersed in poly(vinyl acetate).

13. In a thermal dye transfer assemblage comprising:

(a) a dye donor element comprising a support having thereon a dye layer comprising an image dye dispersed in a polymeric material, said dye layer having an infrared-absorbing material associated therewith, and (b) a dye-receiving element comprising a support having thereon a dye image-receiving layer, said dye-receiving element being in superposed relationship with said dye donor element so that said dye layer is in contact with said dye image-receiving layer, the improvement wherein the polymeric material has been coated from an aqueous dispersion and consists essentially of a hydrophilic polymer which has been set, said dye layer also having an overcoat layer comprising spacer beads dispersed in a polymeric binder.

14. The assemblage of claim 13 wherein said hydrophilic polymer is gelatin.

15. The assemblage of claim 13 wherein said infrared-absorbing material is in said dye layer.

16. The assemblage of claim 13 wherein said beads which are employed have such a particle size and are employed in such an amount so that effective contact between said dye-donor and said dye-receiving element is prevented during the laser-induced thermal dye transfer.

17. The assemblage of claim 16 wherein said spacer beads have a particle size from about 5 to about 50 μm and are present at a concentration of from about 60 to about 60,000/cm$^2$.

18. The assemblage of claim 13 wherein said beads are dispersed in poly(vinyl acetate).

* * * * *